US007946572B2

(12) United States Patent
Sheng et al.

(10) Patent No.: US 7,946,572 B2
(45) Date of Patent: May 24, 2011

(54) PAPER PICK-UP MECHANISM AND FEEDER USING THE SAME

(75) Inventors: Thomas Sheng, Hsinchu (TW); Sung-Po Cheng, Hsinchu (TW); Ku-Ming Chen, Hsinchu (TW)

(73) Assignee: Avision Inc. (TW)

( * ) Notice: Subject to any disclaimer, the term of this patent is extended or adjusted under 35 U.S.C. 154(b) by 321 days.

(21) Appl. No.: 12/231,271

(22) Filed: Aug. 28, 2008

(65) Prior Publication Data

US 2009/0057985 A1 Mar. 5, 2009

(30) Foreign Application Priority Data

Aug. 29, 2007 (TW) ..... 96131976 A

(51) Int. Cl.
*B65H 3/06* (2006.01)

(52) U.S. Cl. ..... 271/118; 271/117; 271/10.04

(58) Field of Classification Search ..... 271/117, 271/118, 10.04
See application file for complete search history.

(56) References Cited

U.S. PATENT DOCUMENTS

| | | | | |
|---|---|---|---|---|
| 6,024,356 | A * | 2/2000 | Tanaka et al. | 280/11.214 |
| 6,168,147 | B1 * | 1/2001 | Nose et al. | 271/10.13 |
| 6,332,608 | B1 * | 12/2001 | Tamura | 271/111 |
| 6,390,463 | B1 * | 5/2002 | Iwago | 271/118 |
| 6,581,924 | B2 * | 6/2003 | Gaarder et al. | 271/114 |
| 6,651,971 | B2 * | 11/2003 | Tsuei | 271/109 |
| 6,991,227 | B2 * | 1/2006 | Kim | 271/10.12 |
| 7,059,596 | B2 * | 6/2006 | Iwase | 271/114 |
| 7,099,619 | B2 * | 8/2006 | Choi | 399/367 |
| 7,296,790 | B2 * | 11/2007 | Kim | 271/114 |
| 7,448,612 | B2 * | 11/2008 | Rumford et al. | 271/118 |
| 7,571,905 | B2 * | 8/2009 | Kim | 271/117 |
| 2002/0190459 | A1 * | 12/2002 | Gaarder et al. | 271/109 |
| 2004/0188918 | A1 * | 9/2004 | Morimoto et al. | 271/121 |
| 2005/0146090 | A1 * | 7/2005 | Sawai | 271/264 |
| 2007/0290430 | A1 * | 12/2007 | Lee | 271/117 |

* cited by examiner

*Primary Examiner* — Stefanos Karmis
*Assistant Examiner* — Howard Sanders

(57) ABSTRACT

A paper pick-up mechanism for a feeder includes a pick-up roller, a pick-up roller shaft, a separation roller, a transmission shaft, a gear set and a transmission gear shaft. Two one-way clutches are respectively coupled to the transmission shaft and the transmission gear shaft in parallel. When the transmission shaft is rotated in a direction opposite to a sheet-feeding direction, the gear set, through the cooperation of the two one-way clutches are used as a planetary gear set to lift up the pick-up roller.

20 Claims, 9 Drawing Sheets

PAPER PICK-UP MECHANISM AND FEEDER USING THE SAME

BACKGROUND OF THE INVENTION

1. Field of the Invention

The invention relates in general to a paper pick-up mechanism, and more particularly to a paper pick-up mechanism for a feeder of an image forming apparatus. The image forming apparatus could be a scanner, a copier, a printer, a fax machine or a multi-function peripheral.

2. Description of the Related Art

A conventional feeder has a pick-up mechanism for sequentially feeding a stack of sheets placed on a tray.

As shown in FIG. 8, The pick-up mechanism 90 includes a pick-up roller 91 and a separation roller 92. A motor (not shown) provides a torque to a rotating shaft 922 of the separation roller 92. A gear set 93 is disposed between the rotating shaft 912 of the pick-up roller 91 and a rotating shaft 922 of the separation roller 92 to transmit the torque to the pick-up roller 91. When the sheet-feeding operation is performed, the separation roller 92 and the pick-up roller 91 are rotated in a sheet-feeding direction. When the sheet-feeding operation ends, the rotating shaft 922 of the separation roller 92 and the rotating shaft 912 of the pick-up roller 91 are rotated in a direction opposite to the sheet-feeding direction.

It is to be noted that a torsional spring 94 could be mounted on the rotating shaft 912 of the pick-up roller 91, so the torsional spring 94 generates a lateral force to a frame 95 supporting the rotating shafts 912 of the pick-up roller 91 and the separation roller 92 to lift the pick-up roller 91 away from the tray (not shown) as the rotating shaft 922 of the separation roller 92 is rotated in the direction opposite to the sheet-feeding direction. However, when the sheet-feeding operation ends, the motor, in order to lift up the pick-up roller 91 and to keep the pick-up roller 91 away from the tray, has to continuously provide the torque to drive the rotating shaft 922 of the separation roller 92 in a reverse direction and has to output a power in addition to the power outputted for the lifting of the pick-up roller 91.

In addition, the pick-up mechanism may be further equipped with a one-way device.

U.S. Pat. No. 6,390,463 discloses a paper pick-up mechanism having two spring-type one-way clutches. The two clutches are serially mounted on a rotating shaft of a separation roller and disposed outside a frame. The rotating shaft has many separated sections to be respectively coupled to the two one-way clutches. Because the two one-way clutches are mounted on the rotating shaft with different coiling directions, they have different working directions. When the rotating shaft of the separation roller is rotated in a direction opposite to the sheet-feeding direction, the one-way clutches and the multi-section rotating shaft generate an action force to lift up the pick-up roller and the frame.

However, the clutches are disposed outside the frame, so the clutches may interfere with other elements of the image forming apparatus or the feeder when the clutches are assembled in the image forming apparatus or the feeder. Also, the two one-way clutches in series cannot be easily assembled with the multi-section rotating shaft.

SUMMARY OF THE INVENTION

In order to solve the drawbacks mentioned hereinabove, the invention provides a new paper pick-up mechanism.

An object of the invention is to provide a paper pick-up mechanism, which is used in a feeder to immediately lift up a pick-up roller when a rotating shaft of a separation roller is rotated in a direction opposite to a sheet-feeding direction.

Another object of the invention is to provide a paper pick-up mechanism, which is used in a feeder to keep a pick-up roller lifted when a rotating shaft of a separation roller is not continuously rotated.

Still another object of the invention is to provide a paper pick-up mechanism, which is used in a feeder and has two one-way clutches disposed in parallel. So, the two clutches occupy a small space and cannot interfere with other assemblies when they are being assembled.

The invention achieves the above-identified objects by providing a paper pick-up mechanism, which includes a transmission shaft, a separation roller mounted on the transmission shaft, a pick-up roller shaft, a pick-up roller, a transmission gear shaft and a gear set coupled to the transmission shaft, the transmission gear shaft and the pick-up roller shaft to transmit the torque provided by a motor. Also, a first one-way clutch is disposed on the transmission shaft, and a second one-way clutch is disposed on the transmission gear shaft and in parallel with the first one-way clutch. The pick-up roller is driven to rotate by the transmission shaft through the engagement among the separation roller gear, transmission gear and pick-up roller gear. When the separation roller is rotated in the direction opposite to the sheet-feeding direction, the first one-way clutch and the second one-way clutch drive the gear set to be used as a planetary gear set and thus to lift up the pick-up roller.

Further benefits and advantages of the present invention will become apparent after a careful reading of the detailed description with appropriate reference to the accompanying drawings.

BRIEF DESCRIPTION OF THE DRAWINGS

The above and other objects of the present invention will become readily apparent by reference to the following detailed description when considered in conjunction with the accompanying drawings wherein.

DETAILED DESCRIPTION OF THE INVENTION

Figure 1A:
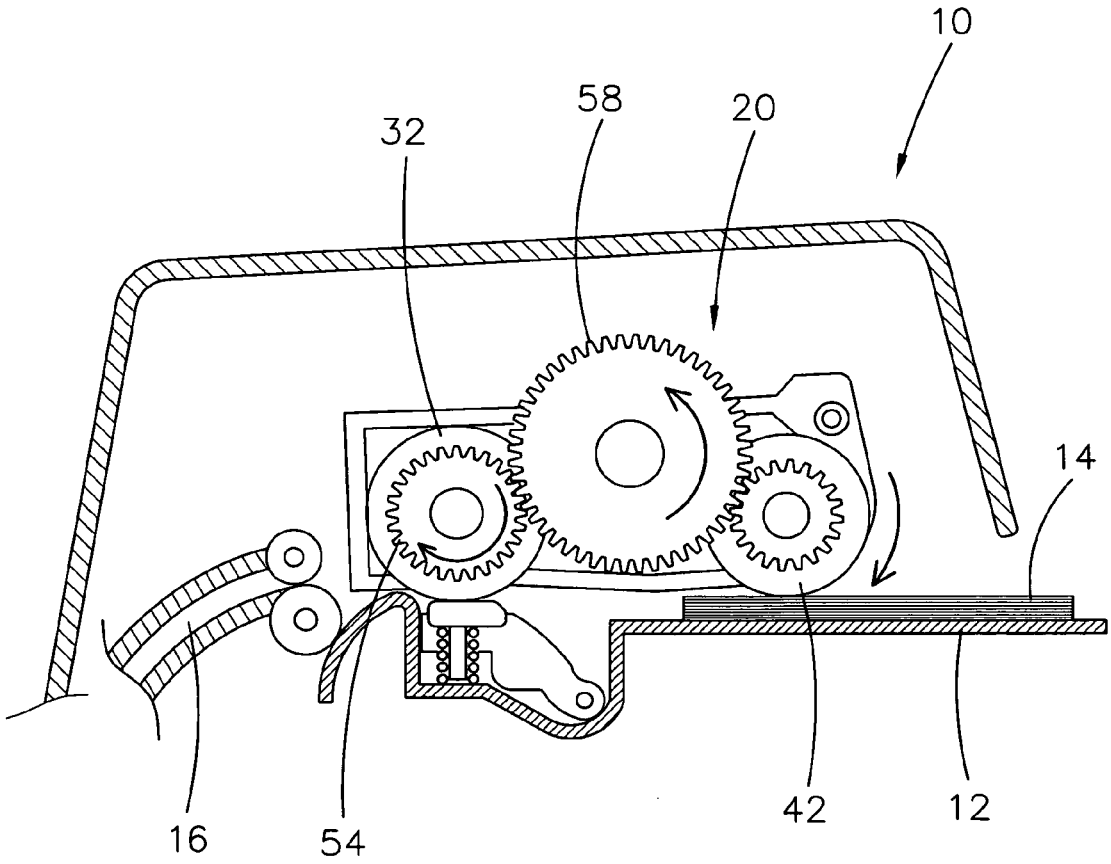
FIG. 1A is a schematic illustration showing a paper pick-up mechanism in a sheet-feeding state according to the invention.
Figure 1B:
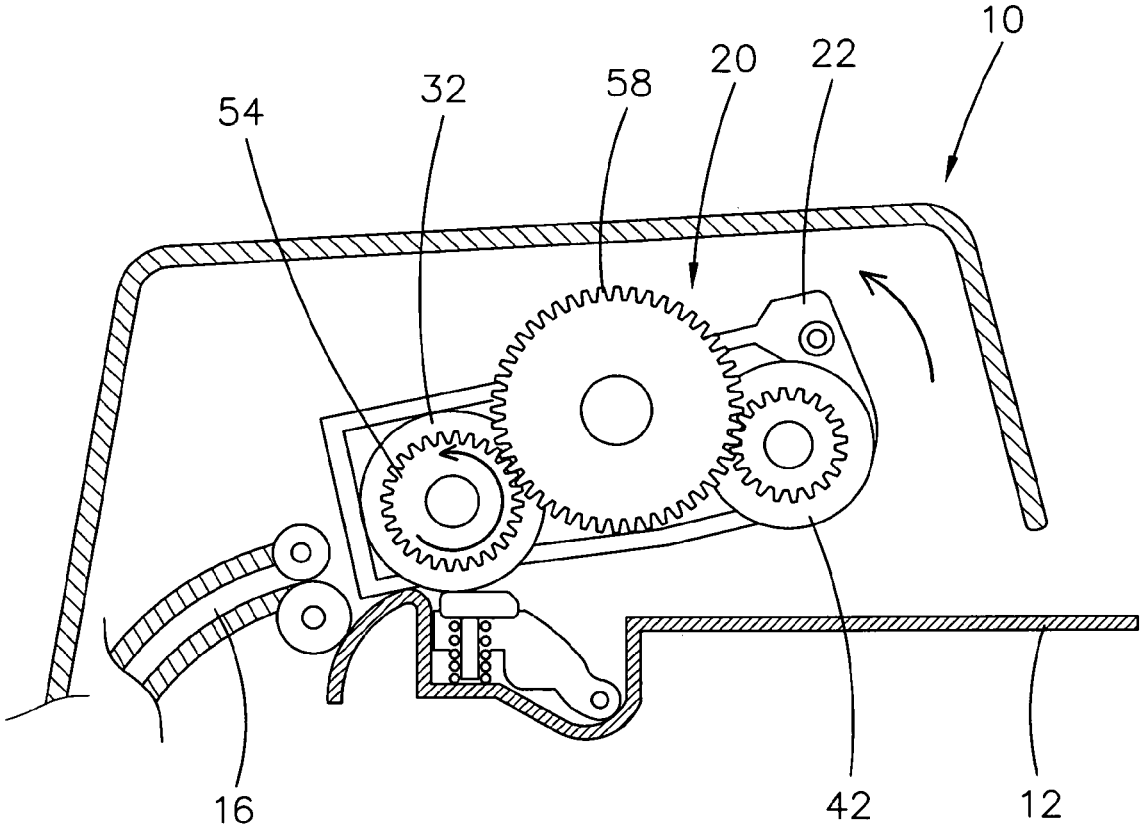
FIG. 1B is a schematic illustration showing the paper pick-up mechanism in a non-sheet-feeding state.

As shown in FIG. 1A, a pick-up mechanism 20 is disposed in a feeder 10. The feeder 10 can automatically and sequentially feed a stack of sheets 14 placed on a tray 12 into a sheet passageway 16 of the feeder 10. As shown in FIG. 1B, when the feeder 10 is in a non-sheet-feeding state, a pick-up roller 42 of the pick-up mechanism 20 is lifted away from the tray 12.

Figure 2:
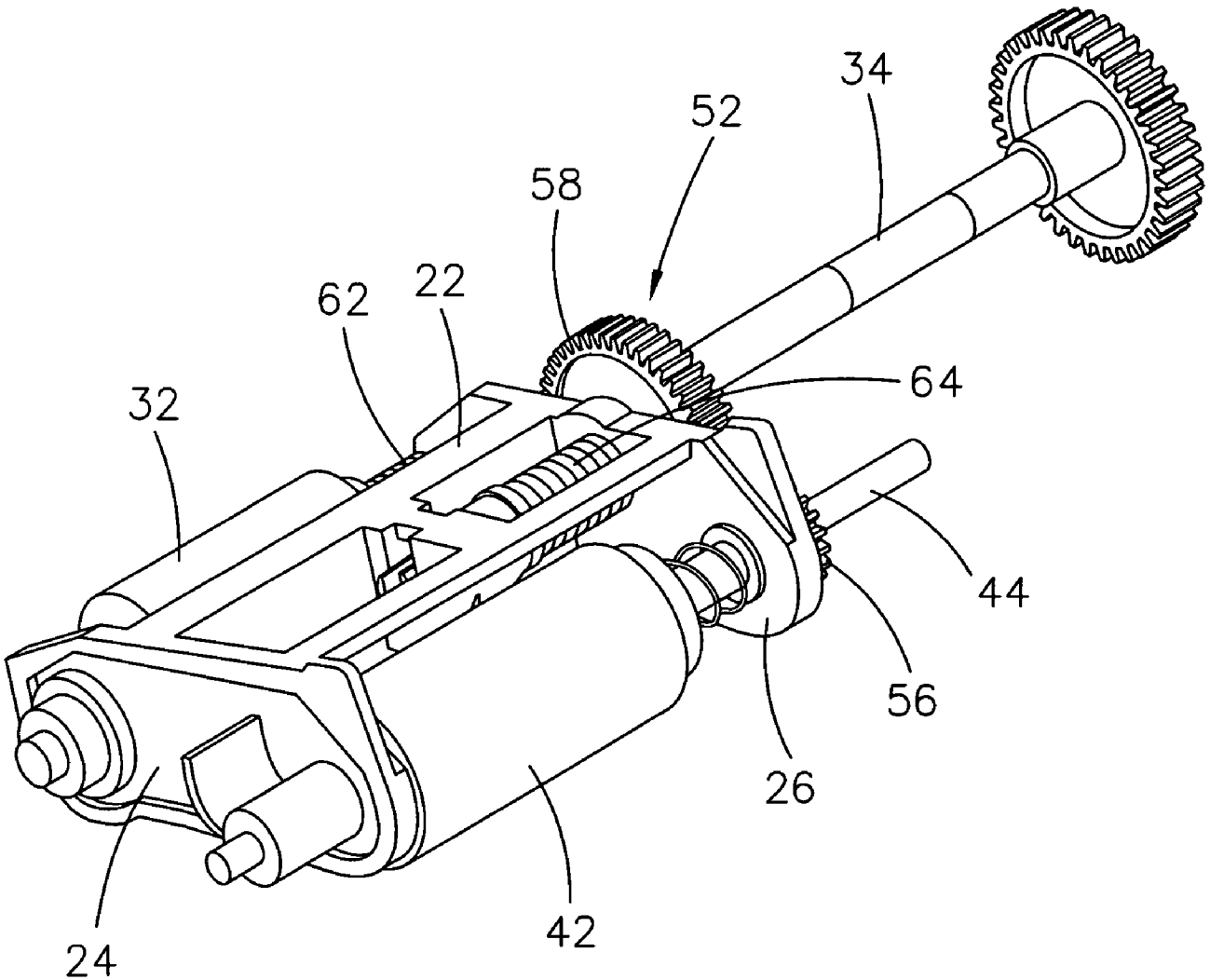
FIG. 2 is a pictorially view showing the paper pick-up mechanism according to the invention.
Figure 3:
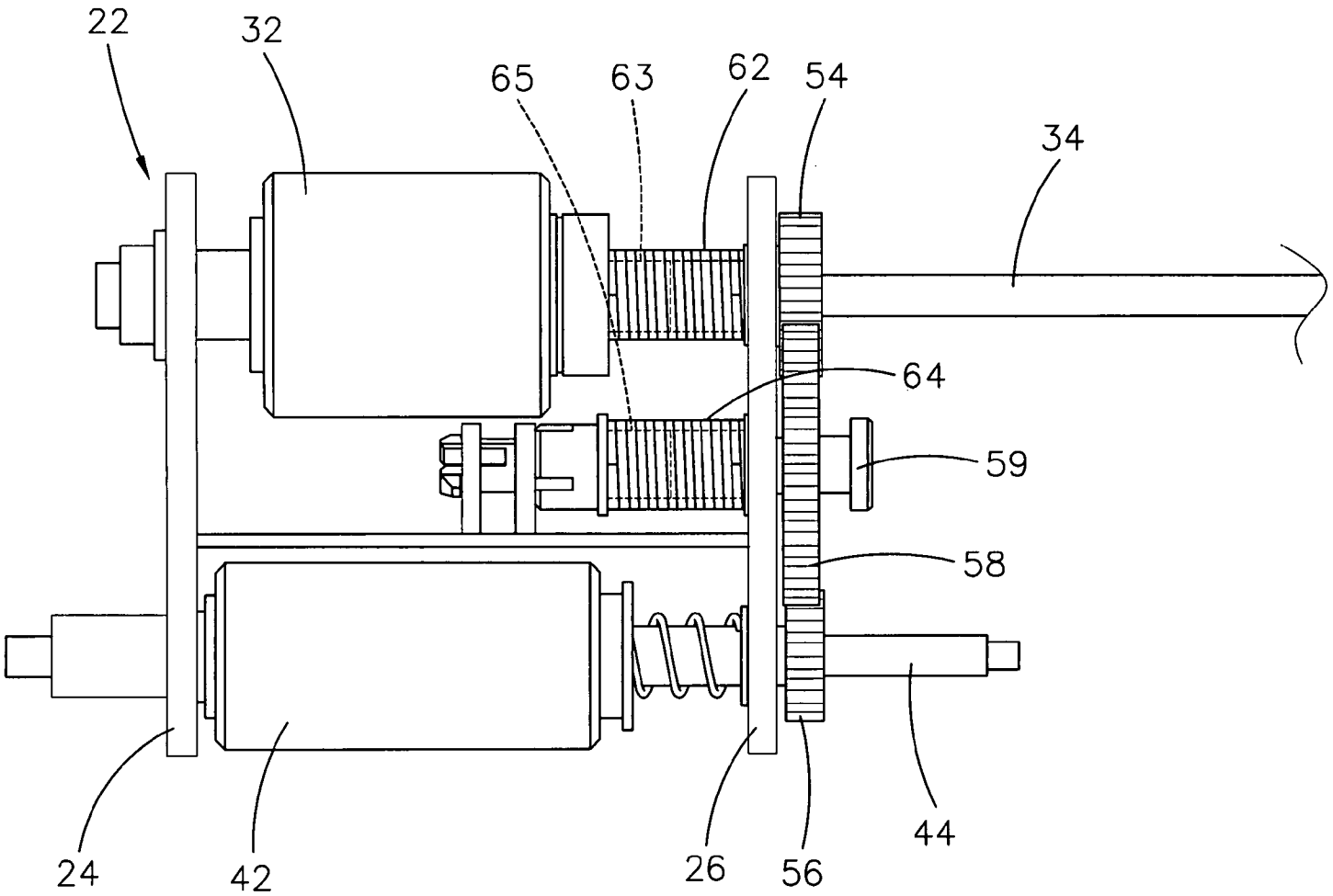
FIG. 3 is a schematic illustration showing the structure of the paper pick-up mechanism according to the invention.

Referring to FIGS. 2 and 3, the pick-up mechanism 20 includes a frame 22, a separation roller 32, a transmission shaft 34, a pick-up roller 42, a pick-up roller shaft 44, a transmission gear shaft 59, and a gear set 52. The separation roller 32 and the pick-up roller 42 are respectively disposed on the transmission shaft 34 and the pick-up roller 42.

The frame 22 has two opposite walls 24 and 26 for supporting the transmission shaft 34, the pick-up roller shaft 44 and the transmission gear shaft 59. The separation roller 32 is located between the walls 24 and 26. The transmission shaft 34 receives a torque outputted by a motor (not shown).

The pick-up roller 42 is located between the walls 24 and 26. Taking the sheet-feeding direction as the reference direction, the pick-up roller 42 is disposed upstream of the separation roller 32. The transmission gear shaft 59 is fixedly disposed between the transmission shaft 34 and the pick-up roller shaft 44.

The gear set 52 includes a separation roller gear 54, a pick-up roller gear 56 and a transmission gear 58. The separation roller gear 54 is coupled to the transmission shaft 34, the pick-up roller gear 56 is coupled to the pick-up roller shaft 44, the transmission gear 58 is coupled to the transmission shaft 59, and the transmission gear 58 is meshed with the separation roller gear 54 and the pick-up roller gear 56. A first one-way clutch 62 is disposed on the transmission shaft 34. The first one-way clutch 62 may be a spring-type one-way clutch. The first one-way clutch 62 is wound around and over the transmission shaft 34 and a bushing 63 of the separation roller 32. The separation roller 32 may rotate in synchronism with the transmission shaft 34 as the first one-way clutch 62 tightens around and presses the bushing 63 of the separation roller 32 against the transmission shaft 34. The pick-up roller 42 and the pick-up roller shaft 44 are driven to rotate by the transmission shaft 34 through the engagement among the separation roller gear 54, the transmission gear 58 and the pick-up roller gear 56. Thus, the pick-up roller 42 and the separation roller 32 are rotated in synchronism in the sheet-feeding direction.

A second one-way clutch 64 is disposed on the transmission gear shaft 59. The second one-way clutch 64 may be a sprint-type one-way clutch. The transmission gear 58 is coupled to the transmission gear shaft 59 via a bushing (not shown) of the transmission gear 58. The second one-way clutch 64 is wound around and over the transmission gear shaft 59 and the bushing of the transmission gear 58. The motion of the transmission gear 58 is constricted as the second one-way clutch 64 tightens and presses the bushing of the transmission gear 58 against the fixed transmission gear shaft 59.

It is to be noted that the first one-way clutch 62 and the second one-way clutch 64 may tighten or loosen on the transmission shaft 34 and the transmission gear shaft 59 as the rotating direction of the shafts changes.

The first one-way clutch 62 and the second one-way clutch 64 are respectively wound around the transmission shaft 34 and the transmission gear shaft 59 in the same direction. When the separation roller gear 54 is rotated with the transmission shaft 34 and meshes with the transmission gear 58, the transmission gear shaft 59 rotates in a direction opposite to that of the transmission shaft. Thus, the second one-way clutch 64 always uncoils around the transmission gear shaft 59, as the first one-way clutch 62 coils around the transmission shaft 34, or vice versa. That is, the second one-way clutch 64 is loose on the transmission gear shaft 59 as the first one-way clutch 62 is constrictive on the transmission shaft 34, or the second one-way clutch 64 is constrictive on the transmission gear shaft 59 as the first one-way clutch 62 is loose on the transmission shaft 34.

A constriction sleeve 65 may be provided and fitted to the transmission gear shaft 59. The second one-way clutch 64 is wound around the bushing of the transmission gear 58 and the constriction sleeve 65. As the second one-way clutch 64 presses the bushing of the transmission gear 58 and the constriction sleeve 65 against the fixed transmission gear shaft 59, the motion of the transmission gear 58 is constricted, and the transmission gear 58 and the constriction sleeve 65 move and stop as one piece.

Figure 4A:
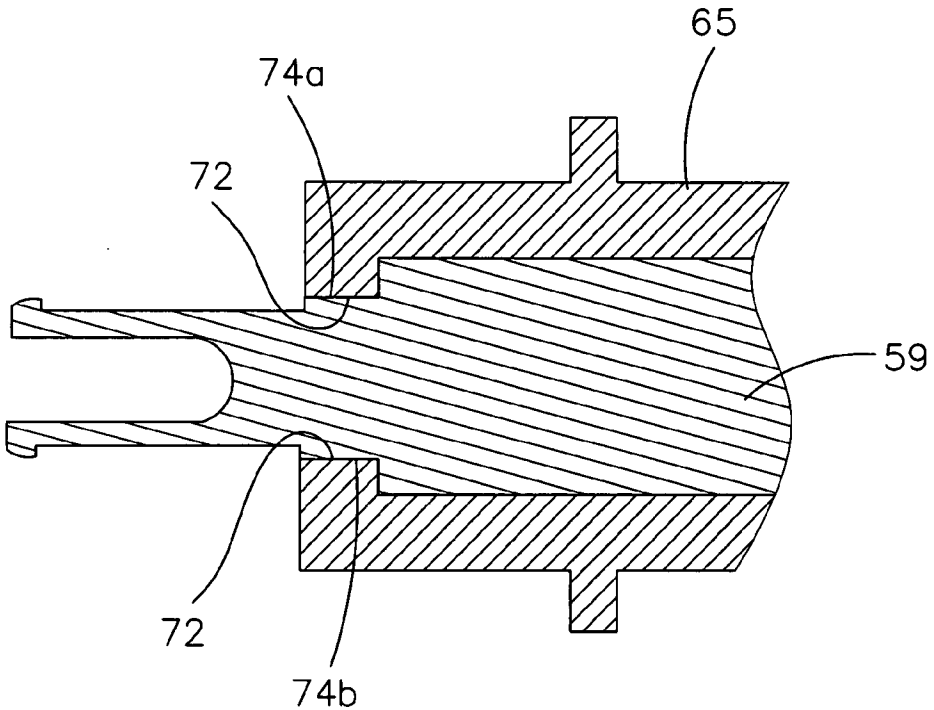
FIGS. 4A and 4B are schematic illustrations showing a transmission gear shaft and a second sleeve assembled together according to the invention.
Figure 4B:
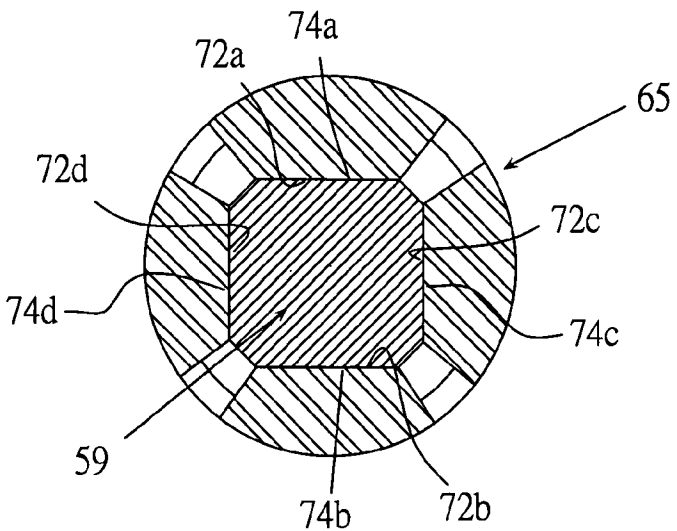

As shown in FIGS. 4A and 4B, an outer surface of the transmission gear shaft 59 is axially formed with at least one plane; in this embodiment, four planes 72*a*, 72*b*, 72*c* and 72*d* are formed, and an inner surface of the constriction sleeve 65 is formed with at least one plane for clamping the plane formed on the outer surface of the transmission gear shaft 59; in this embodiment, four planes 74*a*, 74*b*, 74*c* and 74*d* are correspondingly formed on the inner surface of the constriction sleeve 65. As the constriction sleeve 65 is coupled to the transmission gear shaft 59, the planes 74*a*, 74*b*, 74*c* and 74*d* clamp the planes 72*a*, 72*b*, 72*c* and 72*d*. When the torque on the constriction sleeve 65 is greater than the friction force between the planes 72*a*, 72*b*, 72*c* and 72*d* and the planes 74*a*, 74*b*, 74*c* and 74*d*, a relative movement is generated between the constriction sleeve 65 and the transmission gear shaft 59.

Figure 5:
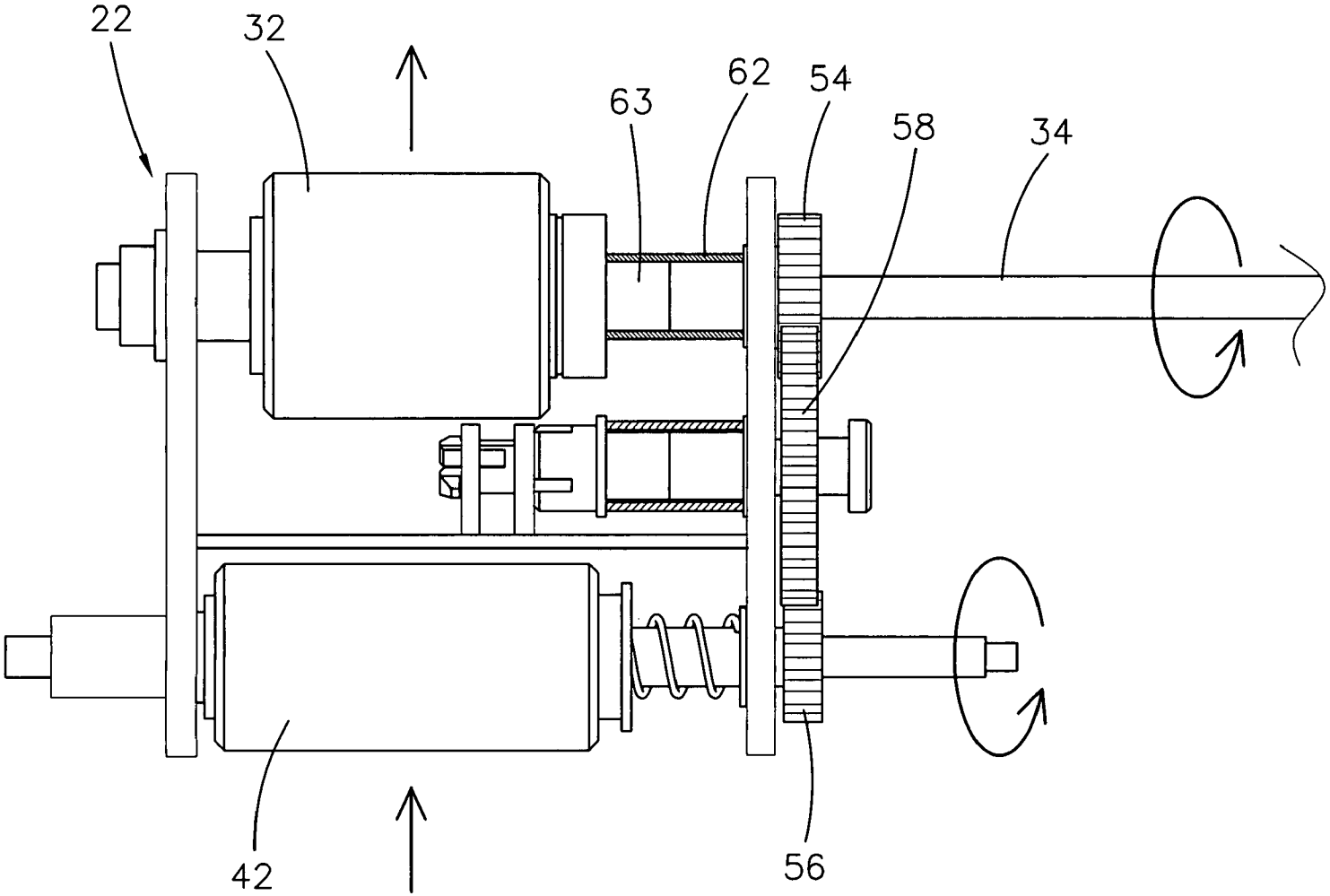
FIG. 5 is a schematic illustration showing the paper pick-up mechanism in a sheet-feeding state according to the invention.

As shown in FIGS. 5 and 1A, as the transmission shaft 34 is rotated in the sheet-feeding direction, the first one-way clutch 62 tightens around the bushing 63 of the separation roller 32 to drive the separation roller 32 to rotate in the sheet-feeding direction.

Also, the separation roller gear 54 transmits a driving force of the transmission shaft 34 to the transmission gear 58 and then to the pick-up roller gear 56. The separation roller gear 54 could be secured and fixed to the transmission shaft 34, such that the separation roller gear 54 rotates with the transmission shaft 34. The transmission gear 58 rotates in a reverse direction, so the second one-way clutch 64 becomes loose, and hence the transmission gear 58 can be rotated to output the driving force to the pick-up roller gear 56 and to rotate the pick-up roller shaft 44 and the pick-up roller 42 in the sheet-feeding direction.

Figure 6:
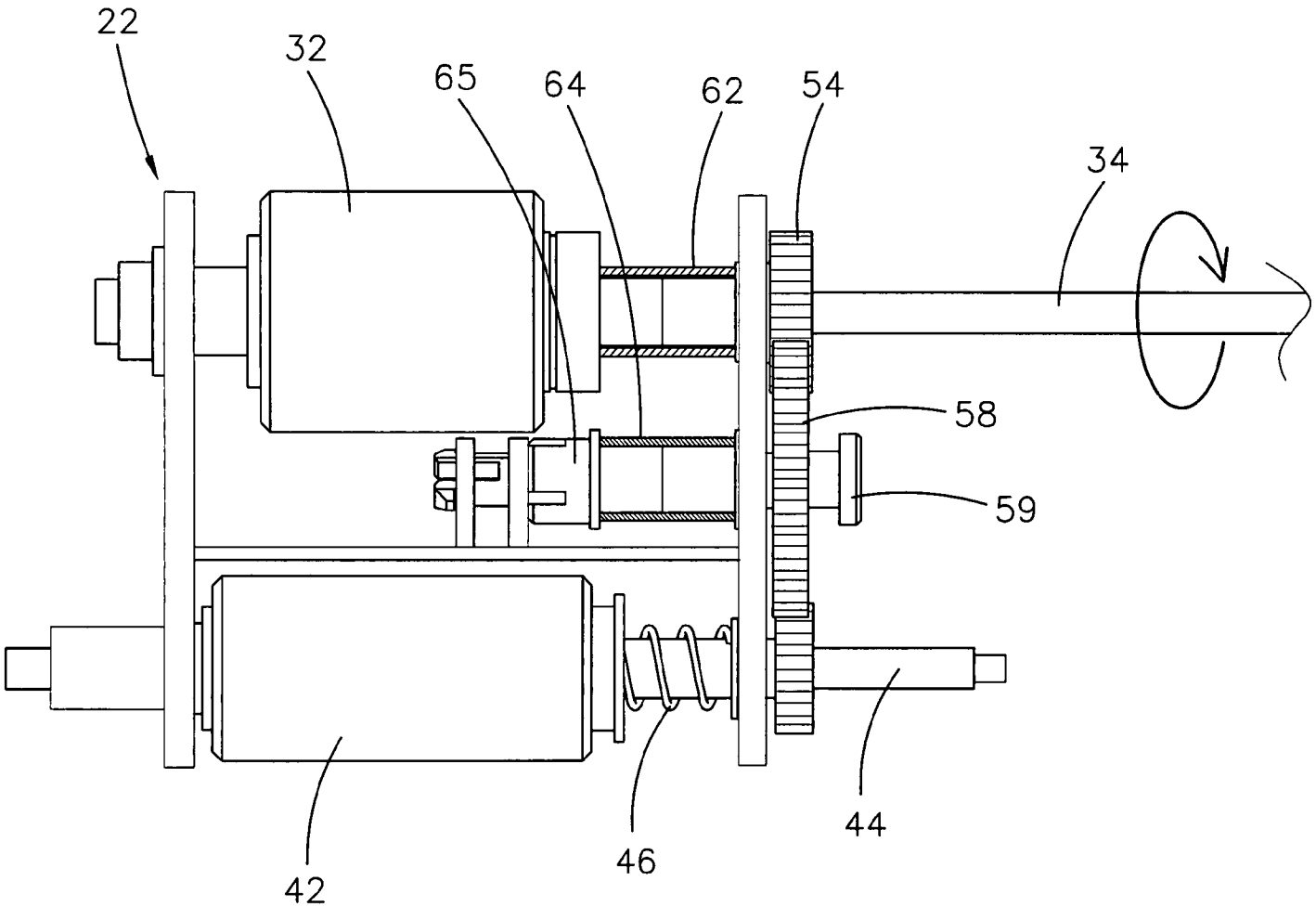
FIG. 6 is a schematic illustration showing the paper pick-up mechanism in a non-sheet-feeding state according to the invention.

As shown in FIGS. 6 and 1B, the transmission shaft 34 is rotated in a direction opposite to the sheet-feeding direction, and the separation roller gear 54 is also rotated in the direction opposite to the sheet-feeding direction. At this time, the first one-way clutch 62 becomes loose and the separation roller 32 is kept stationary.

In a direction opposite of the sheet-feeding, the separation roller gear 54 drives the transmission gear 58 to make the second one-way clutch 64 tightens and presses the bushing of the transmission gear 58 and the constriction sleeve 65 against the transmission gear shaft 59, so that the motion of the transmission gear 58 is constricted.

Hence, since the separation roller gear 54 meshes with the transmission gear 58, under the circumstances, the transmission gear 58 becomes a planet gear of the separation roller gear 54. That is, the transmission gear 58 revolves about the separation roller gear 54 to lift up the frame 22 and the pick-up roller 42. When the motor stops rotating, the transmission gear 58 is still engaged with the separation roller gear 54 and held stationary, so, the pick-up roller 42 and the frame 22 are kept in an upward position. A torsional spring 46 may also be mounted on the pick-up roller shaft 44 to increase the friction force between the pick-up roller shaft 44 and the frame 22 so that the transmission shaft 34 can lift up the frame 22 and the pick-up roller 42 more effectively.

Figure 7:
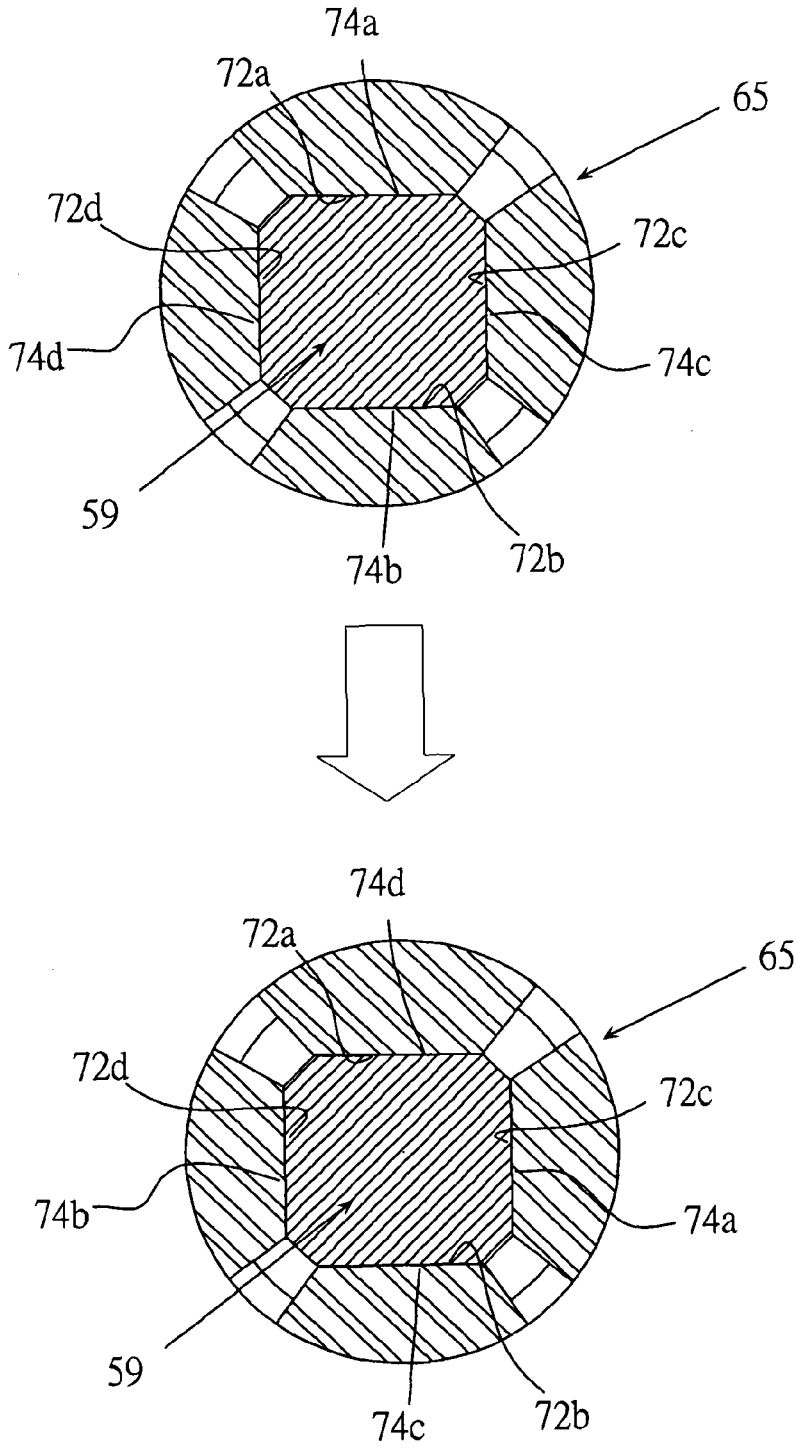
FIG. 7 is a schematic illustration showing that the second sleeve of the invention releases a torque.
Figure 8:
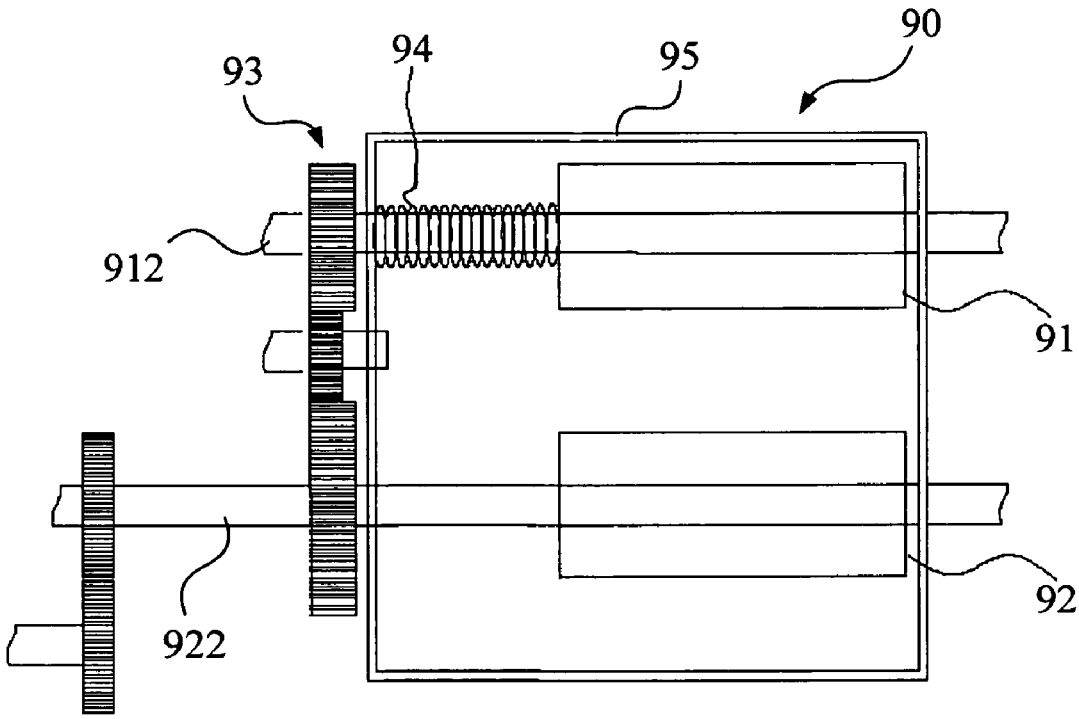
FIG. 8 PRIOR ART
FIG. 8 is a schematic illustration showing the structure of the prior art.

As shown in FIG. 7, when the torque received by the constriction sleeve 65 is greater than the friction force between the planes 72*a*, 72*b*, 72*c* and 72*d* and the planes 74*a*, 74*b*, 74*c* and 74*d*, relative movements are generated between the planes 72*a*, 72*b*, 72*c* and 72*d* and the planes 74*a*, 74*b*, 74*c* and 74*d*. In other words, the constriction sleeve 65 is rotated around the transmission gear shaft 59 to release the torque to prevent the excessive load from being transmitted to the motor.

In this invention, the first one-way clutch 62 and the second one-way clutch 64 are arranged in parallel with each other, and the winding direction of the one-way clutches 62 and 64 matches to each other to lift up the pick-up roller 42 and the frame 22 simultaneously, such that even when the motor is not continuously rotating, the pick-up roller 42 and the frame 22 are kept in the lifted state. Thus, the output power for the performance of the pick-up mechanism of the invention can be reduced.

Moreover, since the first one-way clutch 62 and the second one-way clutch 64 are disposed in parallel with each other and inside the frame 22, the positions of other assemblies in the feeder need not to be changed, and the invention has the advantage of occupying smaller space and can be easily assembled.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A paper pick-up mechanism, comprising:

a transmission shaft rotated in a sheet-feeding direction and in a direction opposite to the sheet-feeding direction;

a separation roller mounted on the transmission shaft and driven by the transmission shaft;

a pick-up roller shaft, driven to rotate by the transmission shaft;

a pick-up roller mounted on the pick-up roller shaft and driven by the pick-up roller shaft;

a transmission gear shaft fixedly disposed between the transmission shaft and the pick-up roller shaft;

a gear set comprising a separation roller gear coupled to the transmission shaft, a pick-up roller gear coupled to the pick-up roller shaft, and a transmission gear coupled to the transmission gear shaft, wherein the transmission gear meshes with the separation roller gear and the pick-up roller gear;

a first one-way clutch, disposed on the transmission shaft; and a second one-way clutch disposed on the transmission gear shaft;

wherein the pick-up roller and the separation roller are rotated in synchronism in the sheet-feeding direction, and wherein when the transmission shaft is rotated in the direction opposite to the sheet-feeding direction, the second one-way clutch constricts the motion of the transmission gear, and the transmission gear acts as a planet gear for the separation roller gear so that the pick-up roller shaft is synchronously lifted up.

2. The paper pick-up mechanism according to claim 1, wherein the transmission shaft and the transmission gear shaft are disposed in parallel.

3. The paper pick-up mechanism according to claim 1, further comprising a frame, wherein the frame supports the transmission shaft, the transmission gear shaft and the pick-up roller shaft, and the gear set is disposed on a side of the frame.

4. The paper pick-up mechanism according to claim 1, wherein the transmission gear is coupled to the transmission gear shaft via a bushing, wherein when the transmission shaft is rotated in the direction opposite to the sheet-feeding direction, the second one-way clutch presses the bushing of the transmission gear against the fixed transmission gear shaft, such that the motion of the transmission gear is constricted.

5. The paper pick-up mechanism according to claim 4, further comprising a constriction sleeve fitting to the transmission gear shaft, wherein when the transmission shaft is rotated in the direction opposite to the sheet-feeding direction, the second one-way clutch presses the bushing of the transmission gear and the constriction sleeve against the fixed transmission gear shaft, such that the motion of the transmission gear is constricted, wherein the transmission gear and the constriction sleeve move and stop as one piece.

6. The paper pick-up mechanism according to claim 5, wherein a relative movement is generated between the constriction sleeve and the transmission gear shaft when a torque on the constriction sleeve is greater than a friction force between the constriction sleeve and the transmission gear shaft.

7. The paper pick-up mechanism according to claim 5, wherein an outer surface of the transmission gear shaft is axially formed with a first plane, and an inner surface of the constriction sleeve is formed with a second plane for clamping the first plane and for fitting the constriction sleeve to the transmission gear shaft.

8. The paper pick-up mechanism according to claim 1, wherein the first one-way clutch and the second one-way clutch are spring-type one-way clutches, and the first one-way clutch and the second one-way clutch are respectively wound around the transmission shaft and the transmission gear shaft in the same direction.

9. The paper pick-up mechanism according to claim 1, wherein when the transmission shaft is rotated in the sheet-feeding direction, the first one-way clutch presses a bushing of the separation roller against the transmission shaft, such that the separation roller rotates synchronously with the transmission shaft.

10. The paper pick-up mechanism according to claim 1, wherein the separation roller gear is fixed to the transmission shaft, such that the separation roller gear rotates synchronously with the transmission shaft.

11. A feeder, comprising:

a sheet passageway; and a paper pick-up mechanism for feeding a sheet on a tray into the sheet passageway, the paper pick-up mechanism comprising:

a transmission shaft rotated in a sheet-feeding direction and in a direction opposite to the sheet-feeding direction;

a separation roller mounted on the transmission shaft and driven by the transmission shaft;

a pick-up roller shaft, driven to rotate by the transmission shaft;

a pick-up roller mounted on the pick-up roller shaft and driven by the pick-up roller shaft;

a transmission gear shaft fixedly disposed between the transmission shaft and the pick-up roller shaft;

a gear set comprising a separation roller gear coupled to the transmission shaft, a pick-up roller gear coupled to the pick-up roller shaft, and a transmission gear coupled to the transmission gear shaft, wherein the transmission gear meshes with the separation roller gear and the pick-up roller gear;

a first one-way clutch, disposed on the transmission shaft; and a second one-way clutch disposed on the transmission gear shaft;

wherein the pick-up roller and the separation roller are rotated in synchronism in the sheet-feeding direction, and wherein when the transmission shaft is rotated in the direction opposite to the sheet-feeding direction, the second one-way clutch constricts the motion of the transmission gear, and the transmission gear acts as a planet gear for the separation roller gear so that the pick-up roller shaft is synchronously lifted up.

12. The feeder according to claim 11, wherein the transmission shaft and the transmission gear shaft are disposed in parallel.

13. The feeder according to claim 11, further comprising a frame, wherein the frame supports the transmission shaft, the transmission gear shaft and the pick-up roller shaft, and the gear set is disposed on a side of the frame.

14. The feeder according to claim 11, wherein the transmission gear is coupled to the transmission gear shaft via a bushing, wherein when the transmission shaft is rotated in the direction opposite to the sheet-feeding direction, the second one-way clutch presses the bushing of the transmission gear against the fixed transmission gear shaft, such that the motion of the transmission gear is constricted.

15. The feeder according to claim 14, further comprising a constriction sleeve fitting to the transmission gear shaft, wherein when the transmission shaft is rotated in the direction opposite to the sheet-feeding direction, the second one-way clutch presses the bushing of the transmission gear and the constriction sleeve against the fixed transmission gear shaft, such that the motion of the transmission gear is constricted, wherein the transmission gear and the constriction sleeve move and stop as one piece.

16. The feeder according to claim 15, wherein a relative movement is generated between the constriction sleeve and the transmission gear shaft when a torque on the constriction sleeve is greater than a friction force between the constriction sleeve and the transmission gear shaft.

17. The feeder according to claim 15, wherein an outer surface of the transmission gear shaft is axially formed with a first plane, and an inner surface of the constriction sleeve is formed with a second plane for clamping the first plane and for fitting the constriction sleeve to the transmission gear shaft.

18. The feeder according to claim 11, wherein the first one-way clutch and the second one-way clutch are spring-type one-way clutches, and the first one-way clutch and the second one-way clutch are respectively wound around the transmission shaft and the transmission gear shaft in the same direction.

19. The feeder according to claim 11, wherein when the transmission shaft is rotated in the sheet-feeding direction, the first one-way clutch presses a bushing of the separation roller against the transmission shaft, such that the separation roller rotates synchronously with the transmission shaft.

20. The feeder according to claim 11, wherein the separation roller gear is fixed to the transmission shaft, such that the separation roller gear rotates synchronously with the transmission shaft.

* * * * *